United States Patent [19]

Francis

[11] Patent Number: 4,500,572

[45] Date of Patent: Feb. 19, 1985

[54] STRUCTURAL SPACER GLAZING WITH CONNECTING SPACER DEVICE

[76] Inventor: Geoffrey V. Francis, 14 Woodgarden Ct., St. Catharines, Ontario, Canada, L2M 7C9

[21] Appl. No.: 509,652

[22] Filed: Jun. 30, 1983

[51] Int. Cl.[3] ..... E06B 3/24

[52] U.S. Cl. ..... 428/34; 52/172; 52/304

[58] Field of Search ..... 52/170–173 R, 52/203, 304, 393, 399, 415, 479, 788–790; 428/34

[56] References Cited

U.S. PATENT DOCUMENTS

| | | | |
|---|---|---|---|
| 2,173,649 | 9/1939 | Firner | 20/56.5 |
| 2,327,974 | 10/1943 | Woelfel | 20/56.5 |
| 2,489,962 | 11/1949 | Hardwick | 126/200 |
| 2,589,064 | 3/1952 | Drake | 20/56.5 |
| 2,708,774 | 5/1955 | Seelen | 20/56.5 |
| 2,933,780 | 4/1960 | Shinefeld | 20/56.5 |
| 3,367,077 | 2/1968 | Johnston | 52/464 |
| 3,971,178 | 7/1976 | Mazzoni et al. | 52/172 |
| 3,981,111 | 9/1976 | Berthagen | 52/171 |
| 4,102,099 | 7/1978 | Gross et al. | 52/171 |
| 4,185,432 | 1/1980 | Eriksson | 52/400 |
| 4,348,435 | 9/1982 | Mistrick et al. | 428/34 |

OTHER PUBLICATIONS

*Sweet's Architectural Catalog File.* Catalog #8, Doors and Windows, 1970, 1973, 1978.

*Primary Examiner*—Marion E. McCamish

*Attorney, Agent, or Firm*—Wegner & Bretschneider

[57] ABSTRACT

A glass insulating sealed unit suitable for capless or stopless glazing comprising two spaced-apart glass plates and spacers to separate and join the glass plates arranged about the entire periphery of the plates and between the plates. The spacers are adapted for connection of the unit to adjoining support members in order to support and fix the unit. One spacer embodiment includes a first section forming substantially enclosed elongate cavity for holding dessicant, which section is positioned between the plates adjacent edges thereof, and second and third sections in form of integral extensions of the first section forming a channel shaped recess, open along the edge. The spacer can include an expansion mechanism to permit one glass plate to move perpendicularly towards or away from the other plate, thereby equalizing the pressures between and outside of the plates. A preferred form of spacer is connected to a support member by means of connectors or clips evenly spaced along the spacer. One form of connector has a stem portion and two flat arms projecting perpendicularly from one end of the stem portion. The thickness of each arm is about equal to the width of a channel-shaped recess formed by the spacer. After the sealed unit is put in place, the connectors are used to connect it by rotating them about their central axes.

36 Claims, 25 Drawing Figures

STRUCTURAL SPACER GLAZING WITH CONNECTING SPACER DEVICE

BACKGROUND OF THE INVENTION

This invention relates to insulating sealed units and in particular to sealed units made from glass plates.

It is well known to construct a glass insulating sealed unit made from two or more spaced-apart sheets of glass with the glass plates being separated by spacers that are made to act as vapour seals or combined with such seals. The gas or air between the glass plates is made vapour free and generally a dessicant material is provided in or in the region of the spacers to maintain the moisture-free environment between the glass plates. It is necessary to maintain a moisture-free condition between the glass plates if the sealed unit is to be kept in a condition where condensation does not form and the unit can always be brought to a very clear, transparent condition. Various arrangements are known at the present time for mounting and supporting the sealed units in a framework or mullion without exterior stops or caps. The interior light or sheet of glass of the unit can be adhered to the structural mullion frame in situ or alternatively this light can be adhered to a framework in a factory and then the total combination can be clipped or bolted in place. Although it is preferable to adhere the inner light to the adjoining framework, it is also possible to adhere both the interior and exterior lights to the framework or just the exterior light. Generally a setting block is placed between the inner surface of the edge portion of the lights and the adjacent framework.

When the interior light is adhered directly to the mullion frame, all the wind and gravity loads acting on the unit pass through the adhesive sealant and, in the event of failure of this sealant, the whole unit can fall out of the frame. A further problem arises from the fact that there is no reliable method of determining whether the seal between the edges of the glass plates has failed.

Another problem with sealed units presently being sold is that the air or gas enclosed and sealed between the sheets of glass expands or contracts during the life of the unit due to temperature change, atmospheric pressure changes, outgassing of dessicant and/or environmental loads such as those caused by wind or snow. This expansion or contraction of the air in the unit can cause the glass to deflect. The deflection in turn produces stresses on the seals which can eventually result in their failure. A further difficulty is that the deflection will produce a distorted reflective image which can be offensive to some users.

U.S. Pat. No. 3,981,111 issued Sept. 21, 1976 to N. T. L. Berthagen describes and illustrates an insulating unit wherein the glass plates are sealingly joined together around their peripheral edges by spacers which act as seals. The spacers are constructed to permit a pivoting movement of one of the transparent plates towards and away from the opposing plate, thereby to increase or decrease the volume of the enclosed gas or air in response to temperature changes.

Recent U.S. Pat. No. 4,348,435 issued Sept. 7, 1982 to PPG Industries Inc. teaches a multiple glazed unit having an organic elastomer sealant about its periphery. The unit is mounted into a curtainwall system by first coating the exposed organic elastomer sealant with a suitable primer before bonding the unit to the curtainwall system with silicone elastomer adhesive.

U.S. Pat. No. 2,708,774 issued May 24, 1955 to Radio Corporation of America discloses a multiple glazed unit having two sheets of glass held apart by an endless frame member of which there are a variety of configurations taught. Although the patent indicates that the web of the frame member, the portion extending between the glass plates is flexible, this flexibility appears to be primarily for manufacturing purposes. The manner by which the sealed unit is to be actually mounted to a building framework is not explained. The patent does teach the use of a frame member or a spacing device that forms a loop that extends outwardly along the edge surfaces of the glass plates. In cross-section the loop is elongate in the direction perpendicular to the major surfaces of the glass plates. In another embodiment the frame member forms a V-shaped recess that extends into the region between the glass plates. It is said in the patent that frame members of this type permit the sealed unit to absorb thermal and physical shock and prevent the transference of the same from one sheet to the other glass sheet.

U.S. Pat. No. 2,589,064 issued Mar. 11, 1952 to Libbey-Owens-Ford Glass Company teaches a sealed glass unit wherein the two glass sheets are separated by a strip that is made of metal having some resilience and that has a looped body portion located between the edge portions of the glass plates. The patent teaches that a separator strip of this type absorbs the strains that result from an excessive outside pressure. The specification teaches special means for connecting the separator strip to each glass sheet. The patent requires that the glass sheets have bevelled edges with metallic coatings thereon. Solder is used to connect the flanges of the separator to the metallic coatings. Again the manner of fastening the sealed unit taught by this patent to an adjoining framework is not explained or illustrated.

It is an object of the present invention to provide an insulating sealed unit that can be glazed without exterior stops or caps and that reduces the loads on the structural sealants by 50% or, in some cases, considerably more.

It is a further object of the invention to provide a glass insulating sealed unit wherein one of the lights of glass will be retained in place in the event of failure by the structural sealant and this will in turn maintain the integrity of the building envelope provided by the glass units.

It is a further object of the invention to provide a glass insulating sealed unit having spacers that permit expansion or contraction of the distance between the edges of the plates so that the sealed interior pressure can be equalized to atmospheric pressure regardless of the extent of temperature or pressure changes.

SUMMARY OF THE INVENTION

According to one aspect of the invention a glass insulating sealed unit capable of being mounted on a building without the use of exterior stops comprises at least two spaced-apart glass plates and spacer means to join and seal the edges of the glass plates arranged about the entire periphery of the plates and between the plates. The spacer means include at least one connecting spacer device extending along at least one side of the unit. The spacer device projects from the side of the unit and is adapted for the connection of the unit to an adjoining support member in order to support and fix the unit so that the exterior glass surface thereof is the outermost point of the unit and adjacent surrounding surfaces of the building.

In one preferred embodiment the spacer device comprises a first section forming a substantially enclosed, elongate cavity for holding dessicant, which section is positioned between the glass plates adjacent edges thereof. A second section in the form of an integral extension of the first section projects outwardly to a position beyond the adjacent edges of the glass plates.

According to a further aspect of the invention a glass insulating sealed unit comprises at least two spaced-apart glass plates and spacer means to connect together and seal the edges of the glass plates arranged about the entire periphery of the plates and between the plates. The spacer means include along each side of the unit an expandible center section and two outer sections that are integral extensions of the center section for attaching the spacer means to inner surfaces of two adjacent glass plates. The outer sections are located on opposite sides of the center section. Non-metallic structural sealant bonds each outer section to the adjacent inside surface of its respective glass plate. At least one of the outer sections and the center section are positioned entirely between edge portions of the two glass plates. The center section comprises a rolled spring loop.

According to a particularly preferred embodiment of the invention, a glass insulating sealed unit comprises at least two spaced-apart glass plates and spacer means to join and seal the edge portions of said glass plates arranged about the entire periphery of said plates and between said plates, said spacer means including at least one connecting spacer device extending along at least one side of said unit having a channel-shaped recess that is open along the edge of the unit, and connecting means for fastening said spacer device to said adjoining support member, said connecting means having a flat end portion with a thickness substantially equal to the width of said recess, wherein said sealed unit is fastened to said support member by insertion of said flat end portion into said recess to form a slide fit between said end portion and the spacer device and wherein said sealed unit is adapted to be held in place and supported on an adjoining support member by the combination of said at least one spacer device and said connecting means. The connecting means can comprise a number of flat or L-shaped metal plates with the aforementioned flat end portion being part of each metal plate. Each plate has a hole therein for passage of a threaded fastener.

Preferred embodiments of the invention will now be described, by way of example, with reference to the accompanying drawings.

DETAILED DESCRIPTION OF PREFERRED EMBODIMENTS

Figure 1:
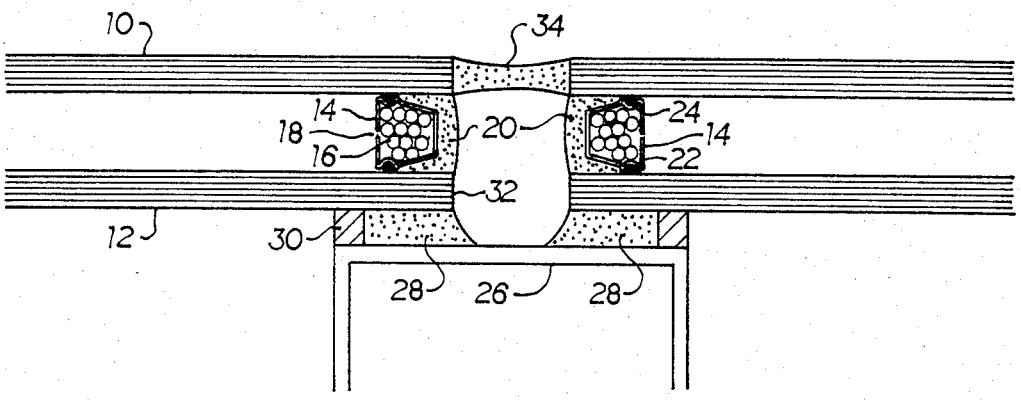
FIG 1 PRIOR ART
FIG. 1 is a sectional detail illustrating one prior art method of sealing and supporting a glass sealed unit, without the use of exterior caps or stops.
Figure 2:
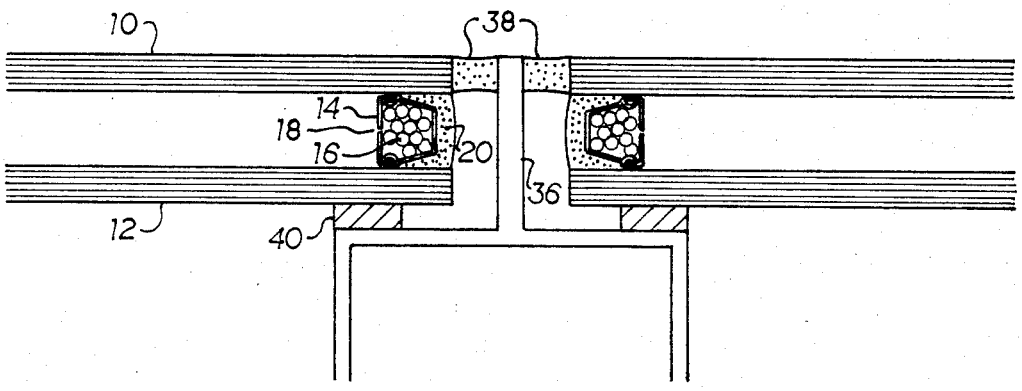
FIG 2 PRIOR ART
FIG. 2 is another sectional detail illustrating an alternative prior art method for sealing and supporting a glass sealed unit, without the use of exterior caps or stops.

FIGS. 1 and 2 of the drawings illustrate alternative methods now used for mounting a glass insulating sealed unit without exterior stops or caps. Other methods are also known in the glazing industry but none of these methods employ the spacer itself to support the sealed unit. In FIGS. 1 and 2 there are two, separated glass plates or lights 10 and 12. These lights are separated by a spacer 14, one of which extends along each of the edges of the sealed unit. The spacer preferably forms a substantially enclosed elongate cavity for holding a dessicant 16. A gap 18 is formed in the inner wall of the spacer so that the dessicant material can remove moisture from the gas or air enclosed by the plates 10 and 12. Located between the edges of the glass plates and about the outer side of the spacer 14 is unit sealing material 20 which preferably is a one part or two part silicone. As shown in FIGS. 1 and 2, the sides of the spacer 14 adjacent the glass plates have an elongate recess running along their length at 22 and 24. Located in these recesses is a vapour seal which provides protection from moisture laden air leaking into the space between the glass plates. In the construction of FIG. 1, the interior glass plate 12 is attached to a mullion frame 26 by means of a structural seal 28. A glass seat 30 is provided along the edge of the structural seal furthest from the edge 32 of plate 12. It will thus be appreciated that the entire glass unit is supported and held in place by the structural seal 28 and the failure of this seal would result in a complete falling out of the sealed unit. In addition to the aforementioned seals, there is provided an additional weather seal 34 extending between the adjacent edges of the exterior plates 10.

The sealed unit shown in FIG. 2 is mounted to a different type of mullion frame, which frame has an outward extension 36 that projects to a point in the plane of the exterior surface of plate 10. Extending between the edge of the glass plate 10 and the extension 36 is a combination weather and structural seal 38. In this embodiment the interior light 12 is not bonded to the mullion. Instead there is simply a glass seat 40 positioned between the light 12 and the mullion. It will thus be appreciated that the entire glass sealed unit is held in place by the adhesive bond between the exterior light and the extension 36. A disadvantage of the prior art constructions shown in FIGS. 1 and 2 is the fact that there is a high stress placed on the structural seals 28 and 38. With these constructions, there will be no warning to the user or to the installer of seal failure and, if the seal fails, the entire sealed unit will fall out leaving an opening in the building envelope. Another problem inherent in such installations is that in order to obtain proper adhesion with the structural seal, the mullion must be properly finished and it is sometimes difficult to ensure the necessary quality control in this regard.

Figure 3:
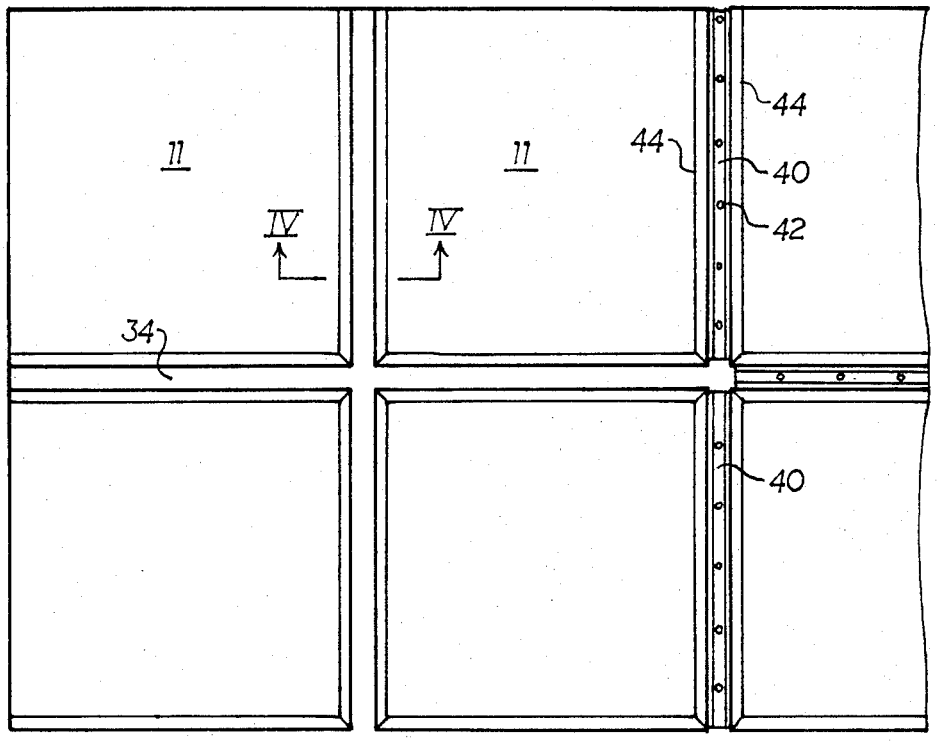
FIG. 3 is an outside view of several sealed units constructed in accordance with the invention and mounted in place.

Turning now to the construction of sealed units constructed in accordance with the present invention, FIG. 3 of the drawings shows several of such units 11 mounted on a suitable mullion frame (not shown). A gap is formed between adjacent sides of the units 11 and this gap is preferably closed by means of the weather seal 34. On the right hand side of the figure, the weather seal has not been put in place in order to illustrate the elongate clamping bars 40 used to attach the sealed units to the mullion frame. Bolts 42 or other suitable fasteners are used to attached the clamping bar to the mullion frame. These bolts 42 extend into holes in the mullion frame as will be explained hereinafter with reference to FIG. 4.

Figure 4:
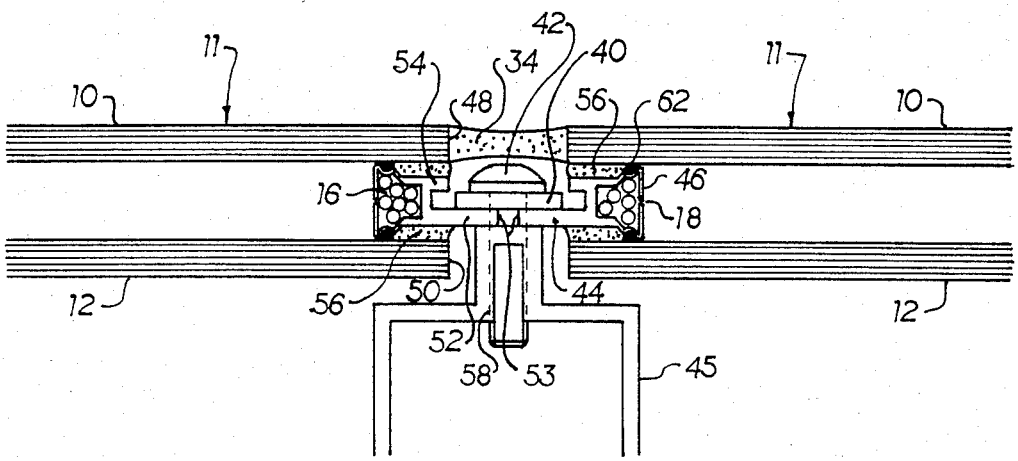
FIG. 4 is a sectional detail taken along the line IV—IV of FIG. 3 showing details of a first embodiment of the invention and how it is connected to a mullion frame.

In FIG. 4 the adjacent edges of two sealed units 11 are shown, which edges are connected to the mullion frame 45 by means of two connecting spacer divices 44. Each device 44 joins and seals the edge portions of the glass plates 10 and 12 and part thereof is located between these glass plates. Each device 44 comprises a first section 46 forming a substantially enclosed, elongate cavity for holding dessicant, which section is positioned between the two glass plates 10 and 12 adjacent the edges 48 and 50 thereof. The spacer device also has a second section 52 in the form of an integral extension of the first section projecting outwardly to a position 53 beyond the adjacent edges 48 and 50 of the glass plates. Preferably the second section 52 is made from a thicker metal than the major portion of the first section 46. The spacer device is preferably constructed from aluminum and the device is shaped as required by an extrusion process.

In the preferred spacer device 44 shown, there is a third section 54 which is an integral extension of the first section 46 and which projects outwardly away from the center of the sealed unit to a location directly between the adjacent edges 48 and 50 of the glass plates. It will be noted that both the second and the third sections are bonded to the glass plates by a structural sealant 56 which preferably is a two part, fast cure silicone sealant. This type of sealant does not break down under ultraviolet light. Each of the two spacer devices 44 is clamped to the end of the million frame 45 by means of the clamping bar 40 and bolts 42. If necessary, a suitable cutout can be provided on the outer end of the section 52 to permit passage of the bolts 42. Threaded holes 58 are formed in the mullion frame to receive the volts 42. An optional glass seat (not shown) can be provided between mullion frame 45 and each plate 12 if desired.

In order that the air between the plates 10 and 12 can reach the dessicant material 16 there is the usual gap 18 provided in the interior wall of the spacer device. The preferred dessicant material is molecular sieve. Instead of using dessicant material such as that shown, it is possible to use a light gas such as argon or argon-halocarbon mixture in the space between the glass lights. Such a gas will not form condensation in the interior of the unit. The use of such gases is well known in the art. Located in the elongate recesses formed in the sides of the first section 46 adjacent the glass plates 10 and 12 there is moisture barrier sealant 62 (also called the vapour seal). The preferred sealant 62 is polyisobutylene which is a viscous material which remains viscous during the life of the sealed unit.

The silicone seals 56 and the structural spacer devices 44 in this embodiment and those described hereinafter should be constructed and arranged to minimize the movement of the vapour seal 62. This can be accomplished by making the hollow first section 46 slightly flexible and by making each silicone seal 56 relatively wide, preferably approximately 8 mm., and relatively thin in the direction perpendicular to the glass plates, preferably approximately 3 mm. The seals should have parallel sides, should not be thinner than 2.5 mm., and should be made with a high modulus silicone. The overall stress on the spacers in units constructed in accordance with this invention are not significantly greater than stresses in the spacers of typical "capped" units because temperature and pressure loads (i.e. inside loads) are usually greater than wind suction loads (outside loads).

With structural spacers of this invention, it can be advantageous to make the inner plate of glass thicker than the outer plate because this will reduce the stress on the outer seal under wind suction load conditions.

Figure 6:
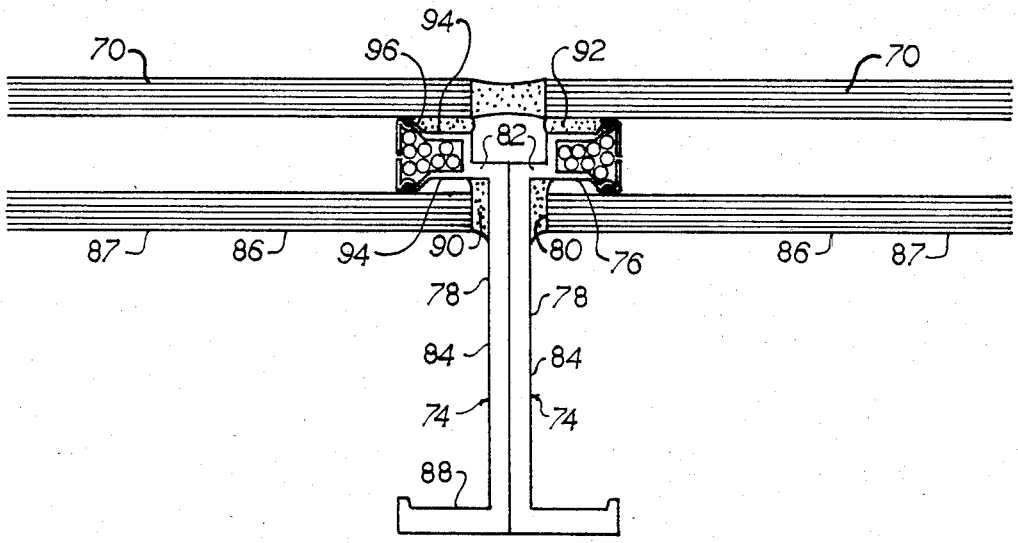
FIG. 6 is a view similar to FIG. 4 showing details of a second embodiment of a sealed unit constructed in accordance with the invention.

In the embodiment of FIG. 6, the adjacent edges of two sealed units are shown and these edges act as the mullion frame. Each connecting spacer device 74 joins and seals the edge portions of the two glass plates that make up each unit. Each device 74 comprises a first section 76 that forms a cavity for holding dessicant in the same manner as the first section 46 of the embodiment shown in FIG. 4. In FIG. 6, the first section 76 extends to a location directly between the edges of the glass plates. The spacer device 74 also has a second section 78 in the form of an integral extension of the first section 76 and this second section comprises all of the portion of the device 74 located outside the space between the two glass plates. Again the second section 78 is thicker than the material forming the first section 76. The second section 78 has first and second legs 82 and 84 with the second leg being considerably longer than the first leg. The first leg 82 extends from the first section 76 parallel to the glass plates to a position located out from the adjacent edges of the glass plates. The second leg 84 extends perpendicularly from the first leg and past the adjacent edge 80 of the inner light to a location beyond the plane of the outer surfce 86 of the inner light. In the illustrated embodiment, the second section 78 also has a third leg 88 that extends perpendicularly from the end of the second leg that is furthest from the first leg 82. If desired the two second legs 84 can be connected to one another to provide stability and support. In order to fasten the interior plate 87 after the frame has been assembled, the spacer devices 74 will typically only be used on two opposite sides of a sealed unit.

With the spacer device of FIG. 6, the second leg 84 can be bonded to the adjacent edge 80 of the inner light by structural sealant 90. Further structural sealant 92 is provided between the first section 76 and the inner surface of the outer light 70. It will thus be appreciated that the spacer device 74 provides direct structural support for both the inner and outer lights.

In the embodiments of FIGS. 4 and 6 and embodiments described hereinafter, the first sections 46 and 76 each have two sides 94 that extend generally parallel to the major surfaces of the glass plates. The portion of the side 94 closest to the edge of the adjacent glass plate is flat but the side bends outwardly at 96 towards the adjacent glass plate. This bend in each side forms a cavity between the flat portion of the side 94 and the adjacent glass plate, which cavity is suitable for the reception of the structural sealant.

Figure 7:
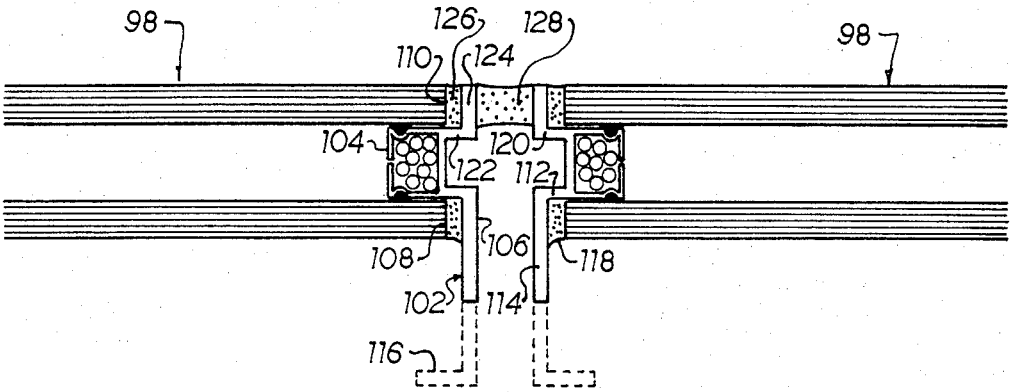
FIG. 7 is a sectional view showing details of a third embodiment.

In the embodiment of FIG. 7, the glass plates of the unit 98 are connected to a mullion frame (not shown) by means of a spacer device 102. The device 102 includes a first section 104 forming the dessicant-holding cavity and located between the two glass plates. The device 102 has a second section 106 in the form of an integral extension of the first section and comprising first and second legs 112 and 114. Thus the second section 106 first projects outwardly to a position beyond the glass edges 108 and 110 and then inwardly past the edge 108. Optionally the second leg 114 may be extended (as shown by the dashed lines 116) into a third leg similar to that shown in FIG. 6. Again the second leg 114 is connected to the edge 108 by structural sealant 118.

In the embodiment of FIG. 7, there is a third section 120 in the form of an integral extension of the first section 104. This third section has a primary leg 122 parallel to the glass plates and extending to a position out from the edges 108 and 110 of the glass plates and a secondary leg 124 extending perpendicularly from the primary leg and along the adjacent edge 110. The secondary leg 124 is bonded to the adjacent edge 110 by structural sealant 126. A weather seal 128 bridges the gap between the secondary leg 124 and a similar adjacent leg.

Figure 8:
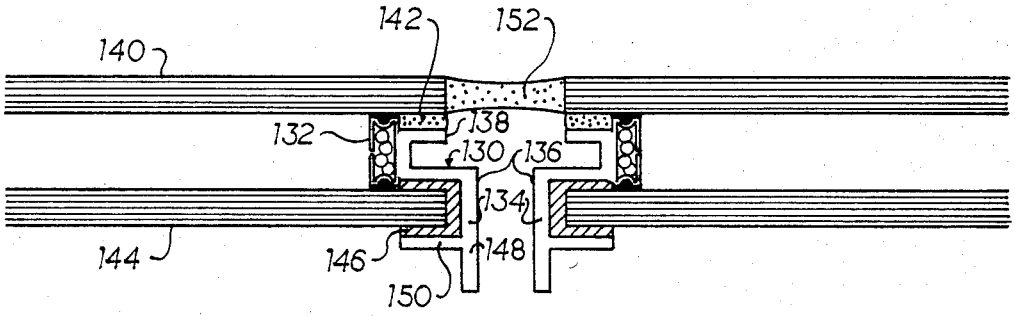
FIGS. 8 to 11 are views similar to FIGS. 6 and 7 but showing further embodiments of the invention.

In the embodiment of FIG. 8 the connecting spacer device 130 has a first section 132 with a cavity for holding dessicant and a second section 134, which is either an integral extension of the first section or a separate element, projecting outwardly to a position 136 beyond the adjacent edges of the glass plates. In this embodiment there is also a third section 138 integral with the section 132 which projects to and ends at a location directly between the adjacent edges of the glass plates. The third section 138 is bonded to the adjacent glass plate 140 by structural sealant 142. Located between the second section 134 and the inner surface and edge of the glass plate 144 is a glass seat 146. As in the embodiment of FIG. 7, the second section has a first leg extending from the first section 132 parallel to the glass plates to the aforementioned position 136. The second section also has a second leg 148 extending perpendicularly from the first leg and past the adjacent edge of the glass plate 144 to a location beyond the plane of the outer surface of the glass plate 144. A flange 150 extends from one side of the second leg 148 along the outer surface of plate 144. The flange 150 is an integral part of the spacer device 130. Again a weather seal at 152 is provided to bridge the gap between adjacent sealed units.

Figure 9:
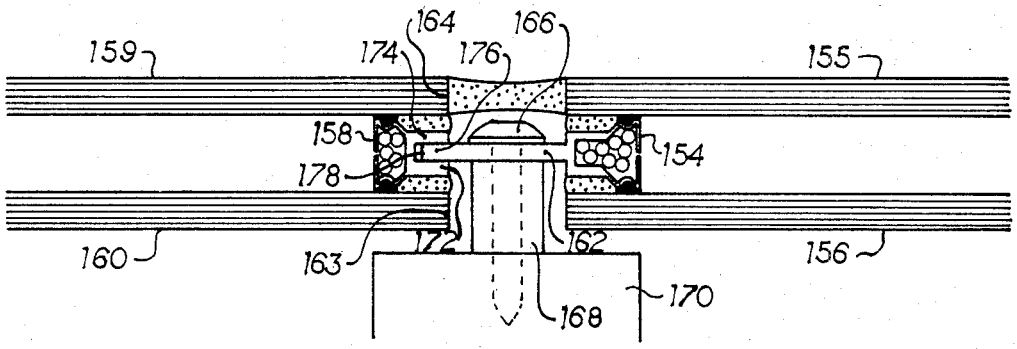

Turning now to FIG. 9, in this embodiment the spacer devices along adjoining edges of adjacent sealed units differ in a manner which permits them to be interconnected to each other. As seen in FIG. 9, the right spacer device 154 joins and seals the edge portions of the glass plates 155 and 156. The left spacer device 158 joins and seals the edge portions of the glass plates 159 and 160. Each of the spacer devices 154 and 158 has a first section forming an elongate cavity for holding dessicant. A second section 162 of the right spacer device is an integral extension of the first section, projects parallel to the major surfaces of the glass plates, and is positioned midway between the planes defined by the outer surfaces of plates 155 and 156. The second section projects outwardly to a position between the adjacent edge portions 163 and 164 of the plates 159 and 160. The section 162 also has holes formed therein for the reception of threaded fasteners 166. These fasteners extend through holes in a spacer 168 and into threaded holes in the mullion frame 170. On the other hand the left spacer device 158 has a second section 172 in the form of an integral extension of the first section projecting outwardly to a position directly between the edges of plates 159 and 160. The left spacer device also has a third section 174 in the form an integral extension of the first section projecting outwardly to a position directly between the edges of the plates 159 and 160. Formed between the second and third sections 172 and 174 is a channel-shaped recess 176 that is open along the edge of the sealed unit. It will be appreciated that the second section 162 of the right spacer device forms connecting means for fastening the left spacer device 158. The second section 162 provides a flat end portion 178 with a thickness substantially equal to the width of the recess 176. When the sealed unit of plates 159 and 160 is to be installed in place, the recess 176 is slid over the flat end portion 178. It will thus be seen that the sealed unit of plates 159 and 160 is adapted to be held in place and supported on an adjoining support member or frame 170 by the combination of the spacer device 158 and connecting means in the form of an integral extension of the spacer device of an adjoining sealed unit.

Figure 10:
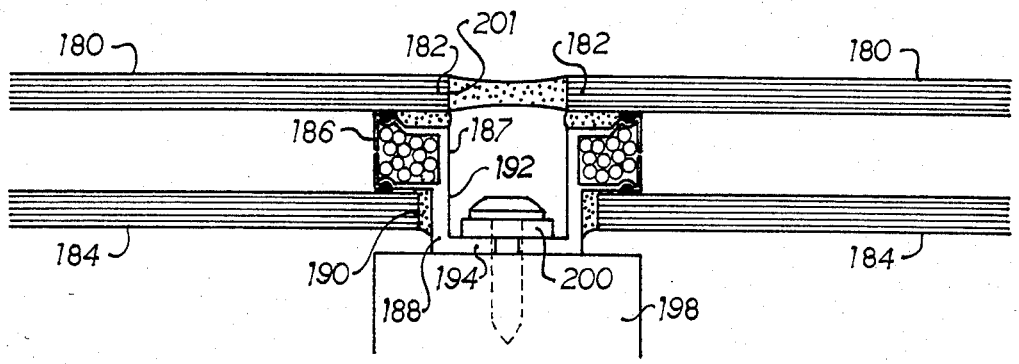

The embodiment of FIG. 10 is similar in many respects to the earlier described embodiment of FIG. 6. Accordingly only the differences between the two embodiments will be described in detail herein. It should first be noted that with the sealed units shown in FIG.

10, the outer lights 180 have edge portions 182 that project beyond the edge portions of the interior lights 184 in order to minimize the gap between the plates 180 which requires a weather seal. These sealed units are called "stepped" units because of the projecting edge portions of one of the lights. It will be appreciated that "stepped" units can be used with any of the embodiments of the present invention described herein if desired. Each spacer device 186 has a first section 187, which section is positioned generally between the glass plates and a second section 188 which, as before, in an integral extension of the first section and which projects outwardly to a position beyond the adjacent edge 190 of the interior light 184. The second section includes a first leg 192 and a second leg 194 perpendicular to the first leg. The two adjacent second legs 194 are clamped to the mullion frame 198 by a clamping bar 200. For purposes of the present invention, the spacer device 186 shall be considered as projecting from the side of the sealed unit even though only the second leg 194 projects beyond the edge 201 of the outer light.

Figure 11:
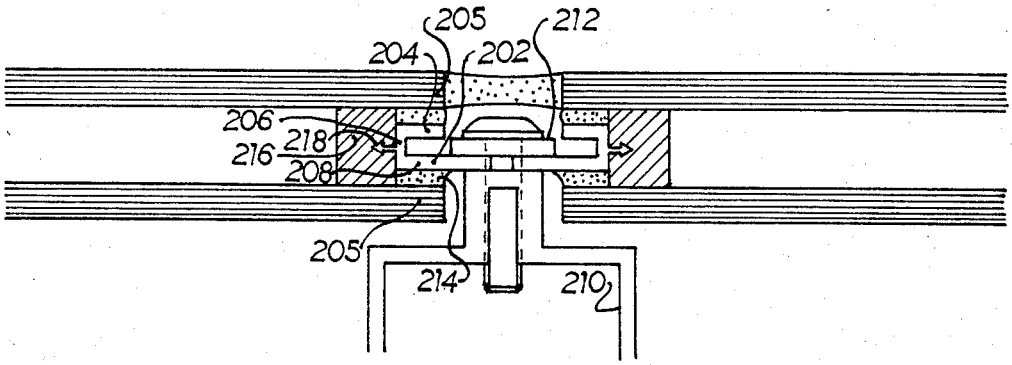

The embodiment shown in FIG. 11 has a spacer device with no dessicant-receiving cavity. The spacer device 202 in cross-section comprises at least three parts integrally connected together. There is a first part 204 extending parallel to the glass plates and disposed entirely between adjacent edge portions 205 of the glass plates. The second part 206 extends perpendicularly from the inner end of the first part 204 and the third part 208 is connected to the second part and extends parallel to the first part to a position beyond the adjacent edges of the glass plates. Structural sealant 214 bonds the first and third parts to the inner surfaces of the adjacent glass plates. Immediately adjacent to the inside surface of the second part 206 is a compound 216 capable of providing a dessicant and a vapour seal. This compound extends between the glass plates and it can be held in place by a flange 218. The compound 216 can be that marketed by Tremco which comprises dessicant impregnated butyl. The third parts 208 are clamped to the mullion frame 210 by clamping bar 212.

Figure 12:
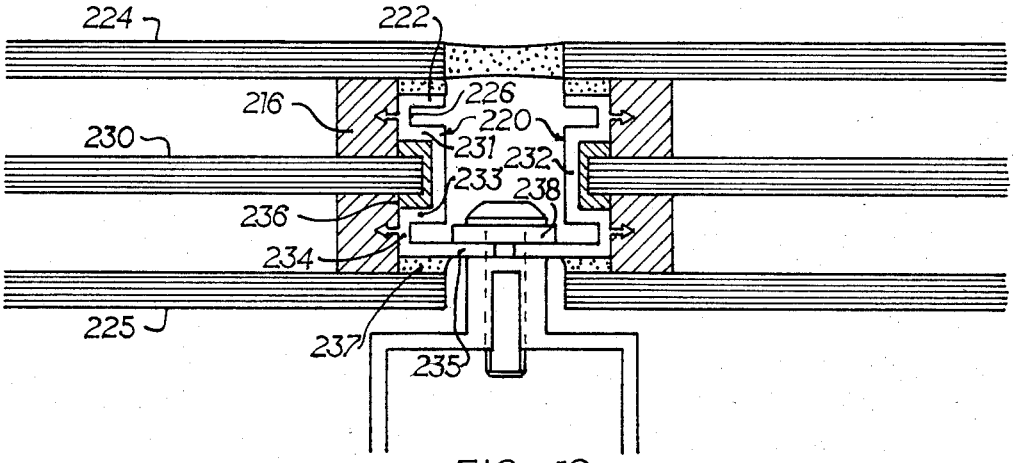
FIG. 12 is a sectional detail showing a triple-gazed sealed unit constructed in accordance with the invention.

The embodiment shown in FIG. 12 is similar to that of FIG. 11 except that each sealed unit comprises three spaced apart glass plates, that is the units connected to the mullion frame by the spacer device 220 are tripled glazed units. The device 220 has a first part 222 extending parallel to the glass plates and disposed entirely and directly between adjacent portions of the exterior glass plate 224 and the interior glass plate 225. It also has a second part 226 extending perpendicularly from the inner end of the first part. A third part consists of a series of five legs 231 to 235, each of which is perpendicular to the adjacent leg or legs. The leg 231 is connected to the second part 226 and extends parallel to the first part to a position beyond the edge of plate 230. Extending around the edge of the glass plate 230 is a glass seat 236 which is held in place by the legs 231, 232 and 233. Structural sealant 237 firmly fastens the fifth leg 235 to the inner surface of the plate 225. Also it is the fifth leg 235 that is clamped to the mullion frame by the clamping bar 238. In order to assemble one of these triple glazed units, the glass plates 224, 225, and 230 are arranged first in their respective relative positions and the compound 216 is applied. The spacer devices 220 are then attached while their ends are unconnected to one another.

Figure 13:
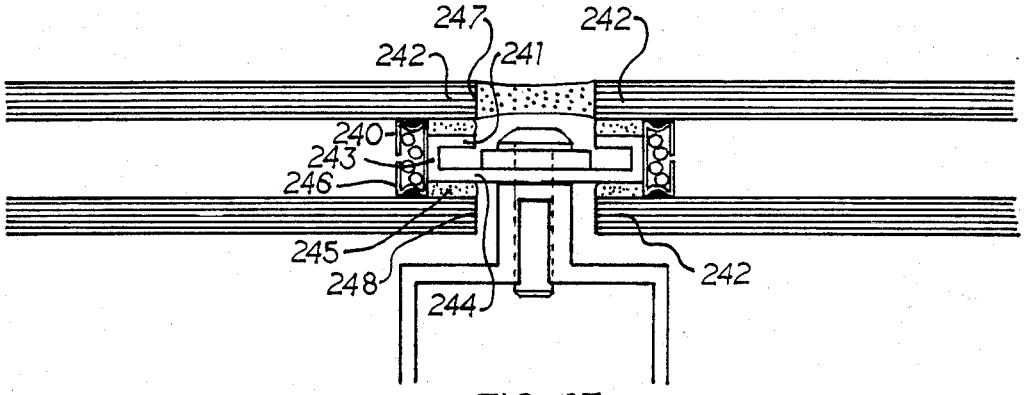
FIG. 13 is a sectional detail of an embodiment wherein the dessicant enclosing chamber is separate from the structural spacer used to support the sealed unit.

The structural spacer 240 shown in FIG. 13 is similar to that shown in FIG. 11 and is clamped to a mullion frame in the same manner. The device in cross-section has three parts integrally connected together including a first part 241 extending parallel to the glass plates and disposed entirely between adjacent edge portions 242 of the plates. A second part 243 extends perpendicularly from the inner end of the first part and is spaced inwardly from the edges of the plates. A third part 244 is connected to the second part and extends parallel to the first part to a position beyond the adjacent edges of the glass plates. Structural sealant 245 bonds the first and third parts to the glass plates. Unlike the embodiment of FIG. 11, there is a separate spacer member 246 positioned adjacent to the spacer device 240 on the side of the second part 243 furthest from the adjacent edges 247 and 248 of the glass plates. The spacer member 246 forms a substantially enclosed elongate chamber for holding dessicant and can be held in place by the sealant 245.

Figure 14:
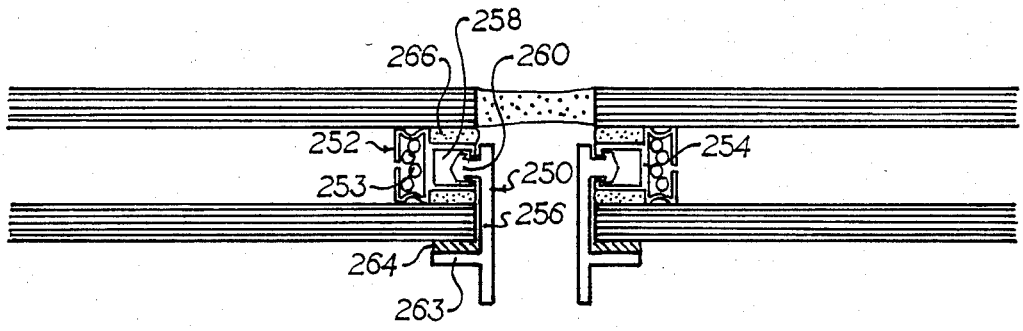
FIG. 14 is a sectional detail of a spacer device constructed in accordance with the invention, which device is made up of two separate members.

In FIG. 14 the spacer device 250 comprises two separate members securely fastened together. This embodiment allows "standard" manufacturing techniques to be used in the construction of the unit. It has the further advantage of permitting the sealed unit to be fixed in place from the interior of the building if required. The first member 252 forms a substantially enclosed, elongate cavity 253 for holding dessicant. The first member also has means on the outer wall 254 for holding the second member 256. While the first member 252 is located entirely between the glass plates, the second member extends outwardly from the first member to a position beyond the adjacent edges of the glass plates. The holding means of the first member 252 define an elongate slot 258 which is wider at the bottom than at the mouth thereof. The second member 256 has an anchor portion 260 adapted to be inserted in "snap" fashion in the slot 258 and too wide to be pulled through the mouth of the slot. The second member may be constructed in any manner suitable for connecting the spacer device to the adjoining frame. The illustrated second member extends past the edge of the interior light to a flange 263 and beyond. The flange 263 extends parallel to the outer surface of the interior light and is close to this outer surface. A glass seat 264 is inserted between the flange 263 and the edge portion of the interior light. It should also be noted that structural sealant 266 bonds the exterior surfaces of the holding means to the glass plates on opposite sides of the first member 252.

Figure 15:
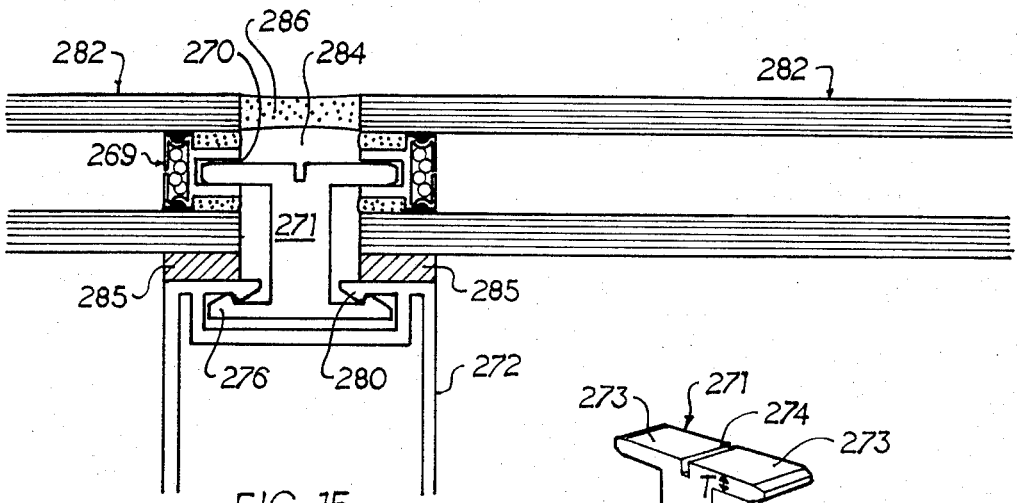
FIG. 15 is a sectional detail showing how two sealed units can be connected to a support frame by means of H-shaped connectors.
Figure 16:
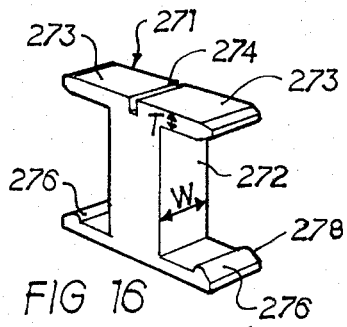
FIG. 16 is a perspective view of the H-shaped connector shown in FIG. 15.

FIGS. 15 and 16 illustrate another form of combination that can be used to provide a structural spacer capable of supporting a sealed glass unit. In this embodiment each spacer device 269 is constructed in essentially the same manner as the left spacer device 158 in FIG. 9. Thus each device forms a channel-shaped recess 270 that is open along the edge of the unit. H-shaped connectors 271 are provided to fasten adjoining spacer devices to the mullion frame 272. Typically these connectors can be spaced apart 6 inches or so with the spacing based upon wind suction design load. The construction of each connector 271 can be seen clearly from FIG. 16. The connector includes a stem portion 272 having a square or rectangular cross-section, and two generally flat arms 273 projecting perpendicularly from one end of the stem portion 272. Each of these flat arms has a thickness indicated by the arrow T slightly less or substantially less than the width of the aforementioned recess 270. The top surface of the arms 273 is separated by a groove or slot 274 into which the end of a standard screwdriver or other suitable tool can be inserted for rotating the connector about a longitudinal axis extending through the center of the stem portion 272. Extending outwardly from the bottom end of stem portion 272 are hook members 276. Each hook member has an upwardly extending lip 278 adapted to snap under another lip 280 formed in the mullion frame as shown in FIG. 15.

In order to employ the connectors 271, the complete sealed units 282 are put in the required position on the mullion frame and are set on setting blocks in the conventional manner. At this time there is an open gap 284 between the sealed units and the connectors 271 can be inserted through this gap when the arms 273 extend parallel to the edges of the sealed units. A slot is provided in the mullion frame to accommodate the bottom end of the connector therein. The width of the connector indicated by the arrow W in FIG. 16 is less than the width of this slot in the mullion frame. After insertion of the bottom end of the connector into the slot, it is then possible to turn the connector by inserting a screwdriver in the slot 274 so that it is brought to the position shown in FIG. 15. In this position the hook members 276 are locked into the mullion frame. At the same time the arms 273 extend into the two opposing recesses 270. Preferably there is a sliding fit between each arm and its respective spacer device to permit each sealed unit some movement after installation. However it will be understood that the arms act to clamp the sealed unit to the mullion frame via the spacer device. Glass seats 285 are provided between the interior light of each sealed unit and the mullion frame. After the connectors have been installed, the gap 284 can be closed by means of a weather seal material 286.

Figure 17:
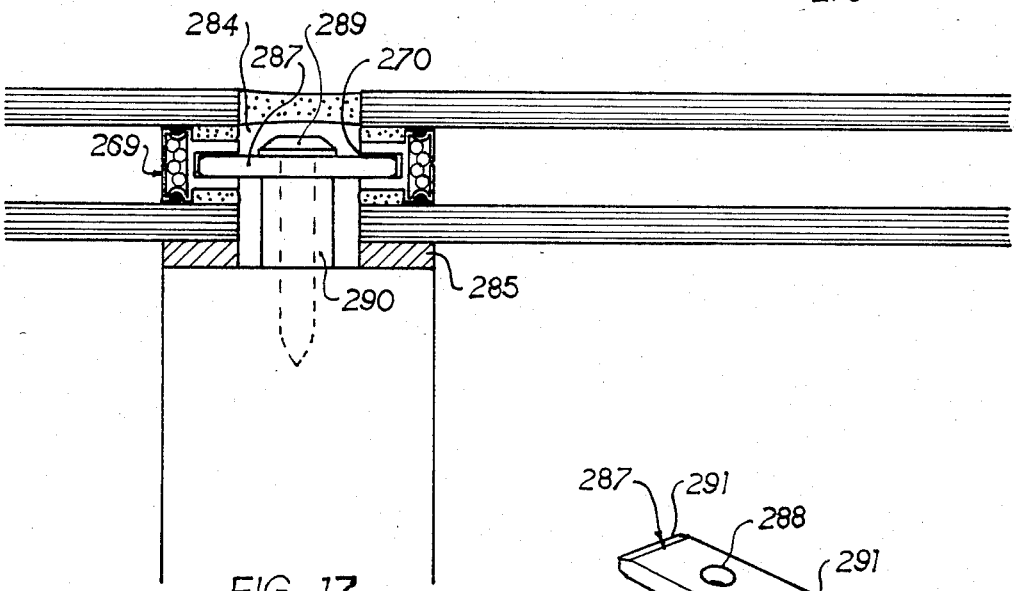
FIG. 17 is a sectional detail showing how the edges of two sealed units can be connected by means of connecting bars that extend between the edges of the sealed units and that are slide fitted at their ends into recesses formed in the spacer devices.
Figure 18:
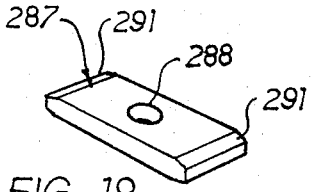
FIG. 18 is a perspective view of the connecting bar used in the embodiment of FIG. 17.

Except for the means to attach the spacer devices to the mullion frame, the embodiment shown in FIG. 17 is similar to that shown in FIG. 15. The spacer devices 269 of the sealed units are exactly the same as are the glass seats 285. Extending between the adjacent spacer devices at intervals of about 6 inches are flat, elongate metal plates 287, the construction of which can be seen clearly from FIG. 18. Located in the center of each plate is a hole 288 for receiving a threaded fastener 289. The plate 287 rests on a spacer sleeve or bar 290 through which extends a hole for passage of the fastener 289.

The aforementioned plate 287 is sufficiently narrow that it can be inserted through the gap 284 between the edges of the sealed units. The plate can then be turned 90° into the recesses 270 of the spacer devices. Optionally a nib is provided in the bottom of each plate 287 and this nib locates a groove in the spacer 290 at the correct rotation. If a nib and groove are used, then the spacer 290 should be an integral part of the mullion. It will be appreciated that the end portions 291 of each metal plate have a thickness slightly less or substantially less than the width of the recesses 270. The thickness of the end portions is such that a sliding fit is preferably formed between these end portions and the two spacer devices connected thereto. If desired each end portion 291 can be bevelled as shown to permit easy insertion into the recesses 270. The plates 287 are adapted to clamp the sealed units to the frame via the spacer devices 269.

Figure 19:
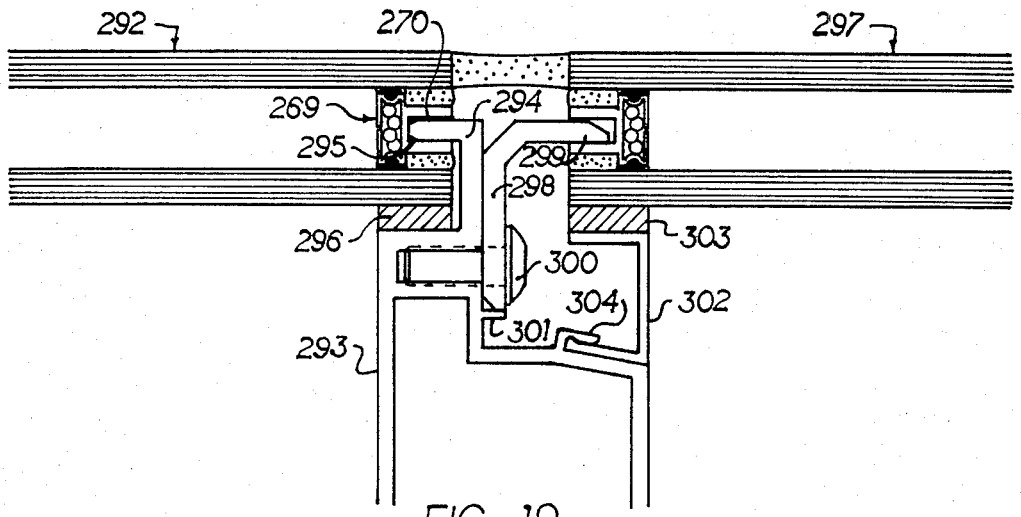
FIG. 19 is a sectional detail of a spacer device which permits the sealed units to be mounted to the mullion frame from the inside of the building.
Figure 20:
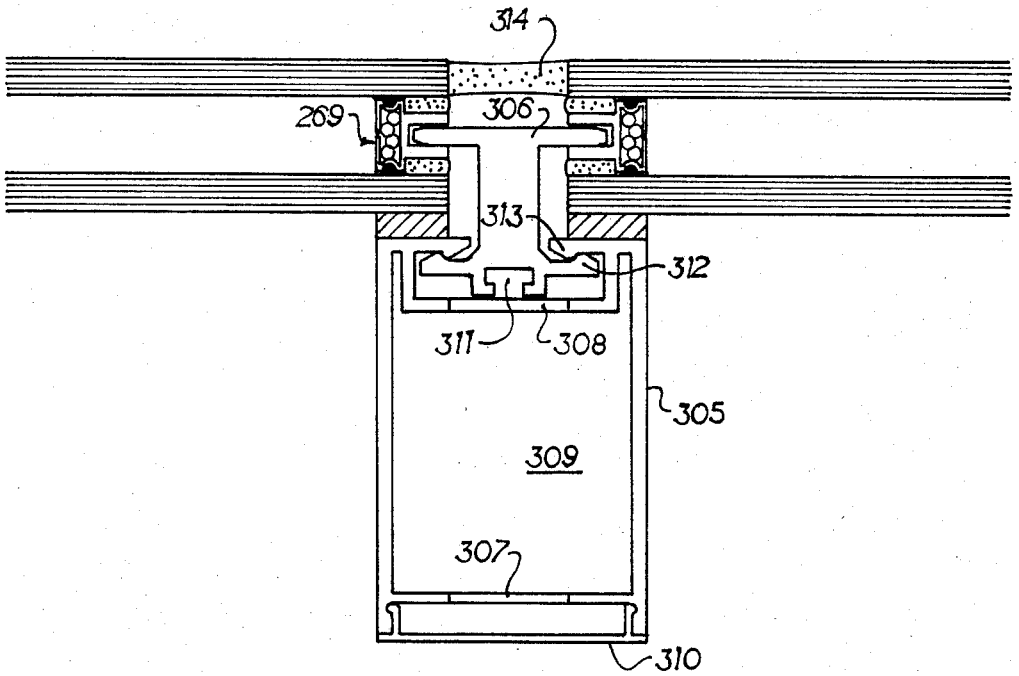
FIG. 20 is a sectional detail showing how two sealed units can be connected to a support frame from the inside of the building using H-shaped connectors.

FIGS. 19 and 20 illustrate structural spacer devices constructed in accordance with the present invention which permit the glass units to be installed from the interior of the building. This is particularly advantageous when the sealed units must be installed on the upper floors of high buildings where scaffolding cannot be employed. The spacer devices 269 are constructed in the same manner as eariler described embodiments such as those illustrated in FIGS. 15 and 17. Thus each spacer device provides a channel-shaped recess 270 that is open along the edge of the unit. The left hand sealed unit 292 shown in FIG. 19 is connected directly to the mullion frame 293 which is formed with an integral hook 294, the flat end of which fits snugly in the recess 270. If desired the flat end of the hook 294 can be bevelled at 295 to permit easy insertion. A glass seat 296 is provided between the outer surface of the interior light and the mullion frame. The left hand edge of each sealed unit is mounted in a different manner than the right hand edge. The left hand edge of the unit 297 can be seen in FIG. 19. This edge is connected by means of substantially L-shaped metal plates 298, each of which has a flat end portion 299 provided by one leg. The plate 298 can be a continuous plate along each edge of the unit if desired or there can be a number of individual plates 298 along each edge. A hole for the passage of a threaded fastener 300 is formed in the other leg of the connector. A locating tab 301 can be formed on the mullion frame to properly orient the plate 298 if desired. After the sealed unit 297 has been mounted in place with the plates 298, the gap between the mullion frame and the outside surface of the interior light can be filled in by means of a suitable channel member 302 and a glass seat 303. The innermost side of the channel 302 is held by an integral clip 304 formed on the outwardly facing surface of the mullion frame.

In the embodiment illustrated by FIG. 20, the spacer devices 269 are the same as those shown in FIG. 19 and previous figures. The sealed units are connected to a mullion frame 305 by H-shaped connectors or clips 306. The connectors 306 are constructed in the same manner as the connectors 271 shown in FIG. 15 except that they are provided with means on their inner ends to permit rotation about their central axis. Prior to installation of the sealed units, there is a passageway through the mullion frame provided by openings 307 and 308 and the cavity 309 in the frame. At this time, the cover plate 310 is detached from the mullion frame. Thus it is possible to pass the connector 306 through the mullion frame from the inside of the building so that the two arms are brought into alignment with the recesses in the spacers 269. Then by means of a special screwdriver inserted into the slot or recess 311, it is possible to rotate each connector about the central axis of its stem so that the arms are brought into engagement with the recesses. At the same time, the hook members 312 are snapped over the inwardly directed lips 313 of the mullion frame. After installation of all of the necessary connectors 306, each of the required cover plates 310 can be attached to the innermost wall of the frame 305. The weather seal 314 can be applied from the exterior of the building without difficulty in a well known manner.

Figure 21:
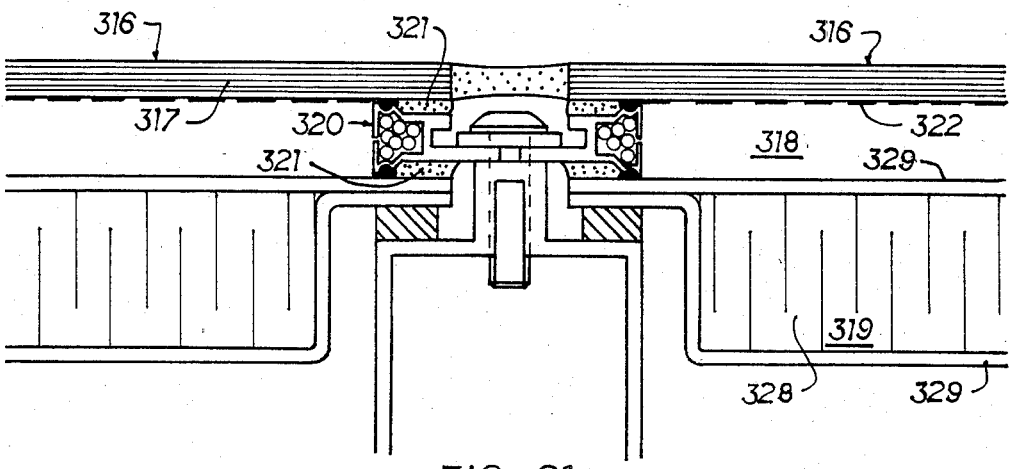
FIG. 21 is a sectional detail showing how the structural spacer of the present invention can be employed to support a spandrel glass panel.

FIG. 21 illustrates how a structural spacer constructed in accordance with the present invention can be used in conjunction with an insulated panel such as a spandrel glass panel. Each spandrel unit 316 has a glass light 317 forming the outside surface, an insulating space 318 and an insulating panel 319 having dimensions lengthwidth and widthwise similar to those of the glass plate. A structural spacer device 320 constructed in essentially the same manner as the spacer devices 44 shown in FIG. 4 joins the light 317 to the panel 319.

Structural sealant is provided at 321 to join the spacer device to the light 317 and the panel 319. Generally, with units of this nature, a reflective material 322 is applied along the inside surface of the light 317 so that the panel 319 can not be readily seen by an outside observer. Each of the panels 319 can be constructed with the use of two, spaced apart metal sheets separated by a layer of polyurethane or polyethylene 328. Insulating panels of this nature are well known as building products. The preferred metal for sheets 329 is either aluminum or steel.

The advantages of the structural spacer in its various forms as described will be readily apparent to those skilled in the construction of sealed glass units. The use of such spacers avoids the need for exterior stops or caps and can reduce the load or tension stress on the seals by 50% or more. Moreover most embodiments of the sealed units of the invention can be manufactured using standard manufacturing processes and these structural spacers can be designed for use with all known types of fastening devices including clips, screws, etc. Further possible advantages include the fact that the construction of the spacers and the use thereof is not dependent on glass thickness. Sealed units constructed in accordance with the present invention can be tested in any of three possible ways in order to determine whether or not seal adhesive failure may have taken place. The units can be visually inspected for condensation, due point tested, or pressure tested. The second method involves the use of the well known "due point" apparatus to test the unit. In pressure testing, gas is blown into the unit via a breather tube installed during manufacture. A failure of the seal during this test will not result in glass fallout but by an almost instantaneous pressure drop, indicating failure.

All of the spacer devices described in detail to this point are rigid in nature in that they do not permit expansion or contraction of the space separating the glass plates. However the spacer device shown in FIG. 22 and most of the subsequent figures are flexible in nature.

Figure 22:
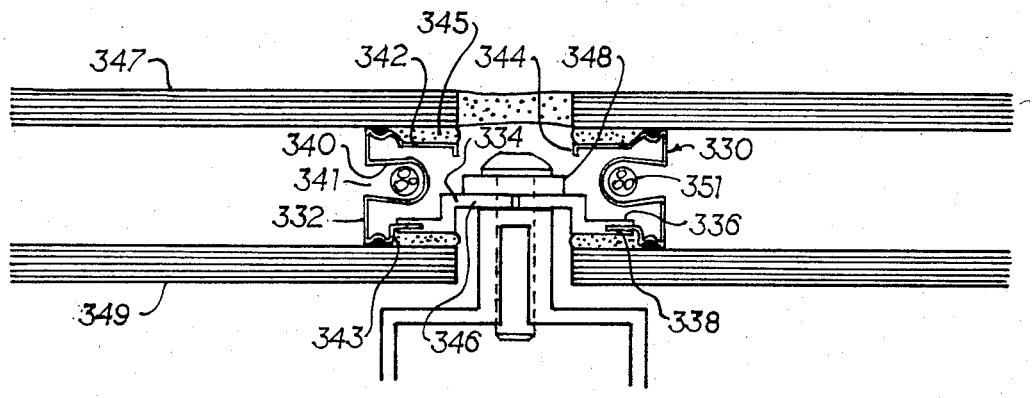
FIG. 22 is a sectional detail of a sealed unit having an expandable spacer which is also used to mount the sealed unit.

FIG. 22 illustrates an expandable structural spacer 330 made up of two components that are rigidly connected to one another prior to construction of the sealed unit. With all of the expandable spacers to be described herein including the spacer 330, it is necessary for the sealed unit to be provided with such spacers along at least two adjacent edges. The first component 332 is made by a continuous rolling process and is thin enough to have the necessary flexibility and resilience. Preferably the flexibility of the expandable spacers described herein is approximately 1 to 4 lb./inch. The spacer must be sufficiently stiff to minimize "rocking" of the sealed unit but flexible enough to reduce glass deflection and seal tensile stress. Very high load gradients, causing excessive rocking, may require one or more of the spacer springs to act as a rigid spacer, allowing only glass rotation movement. The second component 334 is made by an extrusion process so that it has strength and rigidity. The device 330 is a structural spacer as well as an expandable one. Therefore the second component projects beyond the adjacent edges of the glass plates. When the component 334 is initially formed, the inside edge 336 is preferably split into two jaws that are separated to form a gap between them. The surface of each jaw that faces the other jaw can be notched or serrated in order to provide good gripping means when the jaws are closed. The end 338 of the first component is inserted between the two jaws and, preferably as the final rolling step, the jaws are pressed towards one another in order to clamp and grip the end 338.

In the embodiment of FIG. 22. the first component 332 has an expandable centre section comprising a spring loop 340 with an opening 341 facing towards the inside of the sealed unit. The first component also has two outer sections 342 and 343 that are integral extensions of the centre section 340. The outer section 342 at least is attached by non-metallic structural sealant 345 to the adjacent inside surface of glass plate 347. The preferred sealant is a two part, fast cure silicone sealant. The outer section 342 of the spacer may have a short flange 344 formed along its outside edge and projecting towards the second component 334. Structural sealant 345 attaches the second component 334 to the adjacent inside surface of glass plate 349. The sealed unit is held in place by clamping the outwardly extending portion 346 to a mullion frame by means of a clamping bar 348. To provide dessicant for condensation prevention, a dessicant impregnated rope 351 can be located in the spring loop 340. Alternatively the sealed unit can be filled with the aforementioned argon gas or an argon-halocarbon 13 mixture. This more expensive alternative has the advantages of providing higher heat and sound resistance for the unit.

Figure 23:
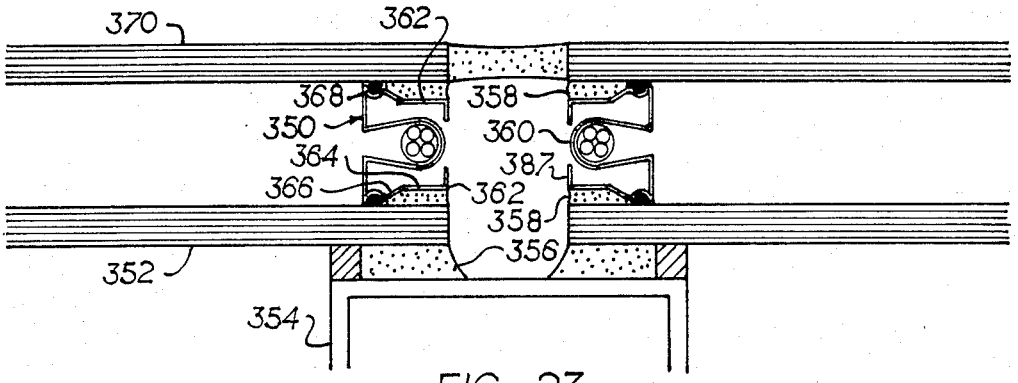
FIG. 23 is a sectional detail showing the use of an expandable spacer and a silicone adhesive for mounting the sealed unit.

FIG. 23 illustrates an expandable spacer 350 that is not employed as a structural spacer, that is a spacer intended to support the entire sealed unit on a mullion frame. The interior light 352 is supported on the frame 354 by means of structual sealant 356 which extends around the entire perimeter of the sealed unit. Further structural sealant at 358 connects the expandable spacer to the interior and exterior lights. The centrally located spring loop 360 connects together the identical outer sections 362. It will be noted that each other section is constructed in the same manner as the outer section 342 of the embodiment shown in FIG. 22. Each outer section is flat in the region 364 for a substantial portion of its width and bends outwardly toward the adjacent glass plate at 366 near its inner edge. The structural sealant 358 is located between the flat region 364 and the adjacent glass plate. Each outer section in the region where it bends outwardly provides and forms a vapor seal seat 368. In the sealed unit of FIG. 23, it will be appreciated that the exterior light 370 is held and supported via the spacer 350 by the interior light 352. Any change in air pressure load on the exterior light 370 will be passed through to the interior light by expansion or contraction of the spacer 350.

Figure 24:
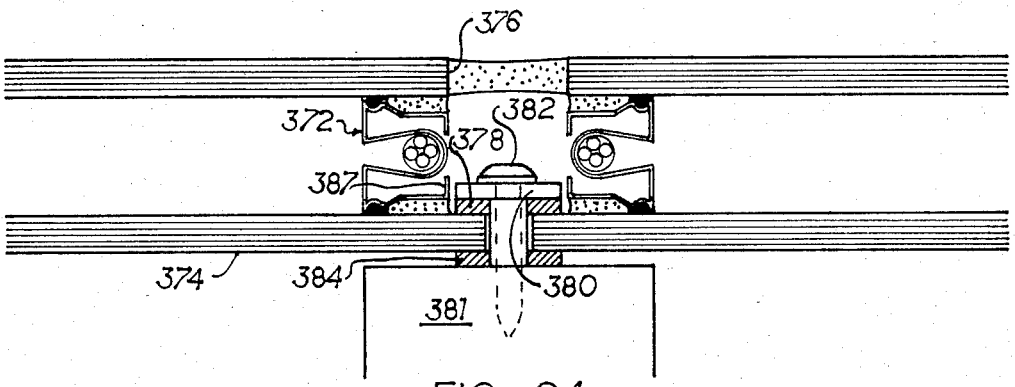
FIG. 24 is a sectional detail showing the use of an expandable spacer wherein the inside sheet extends beyond the edge of the outer sheet.

FIG. 24 illustrates another form of attachment of a sealed unit having an expandable spacer 372 which does not act as a structural spacer. In this embodiment the edge of the interior light 374 projects beyond the edge 376 of the exterior light. In this way it is possible to connect the interior light 374 by means of a metal strip 380 to the mullion frame 381. The strip 380 is connected to the mullion frame by means of threaded fasteners 382. Located between the strip 380 and the inside surface of the light 374 is a glass seat 378. Located between the outer surface of the light 374 and the mullion frame is a further glass seat 384.

Figure 25:
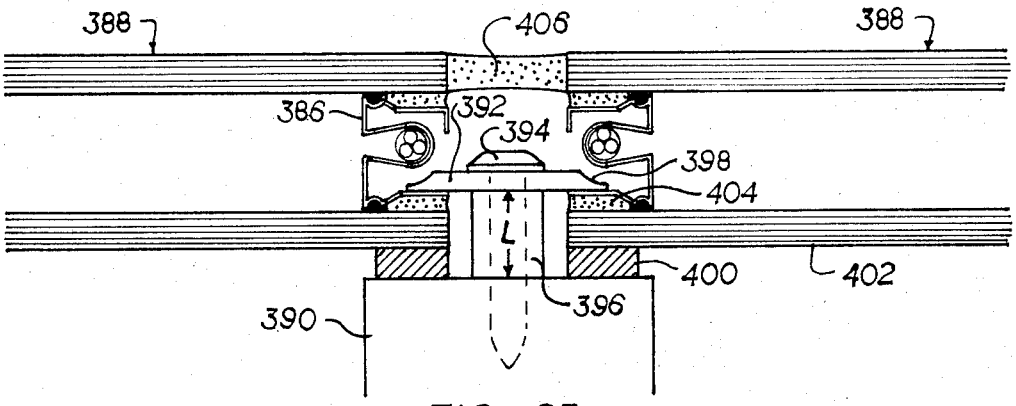
FIG. 25 is a sectional detail showing how expandable spacers can be connected by means of connecting bars that extend between the edges of the sealed units.

In the embodiment of FIG. 25, the expandable spacers 386 are constructed in a manner substantially similar to the spacers shown in FIGS. 23 and 24 except that no flange 387 is formed on the outer section of the spacer that is closest to the interior light. This arrangement permits the sealed units 388 to be connected to the mullion frames 390 by means of spaced-apart connectors 392, threaded fasteners 394, and spacer sleeves or bars 396. The connectors 392 are substantially flat, elongate metal plates similar to that shown in FIG. 18. If desired each end 398 of the connector may be tapered on one side but each end should be flat on the side that engages the spacer. It will be appreciated that the opening through the sleeve 396 is not threaded and is large enough to permit free passage of the fastener 394. The length L of each sleeve 396 should correspond closely to the total thickness of the glass seat 400, the interior light 402, the structural sealant 404 and the outer section of the spacer that is attached to the light 402. Preferably the length L should be slightly less than this total thickness so that the tightening of the fasteners 394 causes the sealed units to be clamped by the connectors 392 to the mullion frame. Again the weather seal 406 is applied after attachment of the sealed units.

Figure 5:
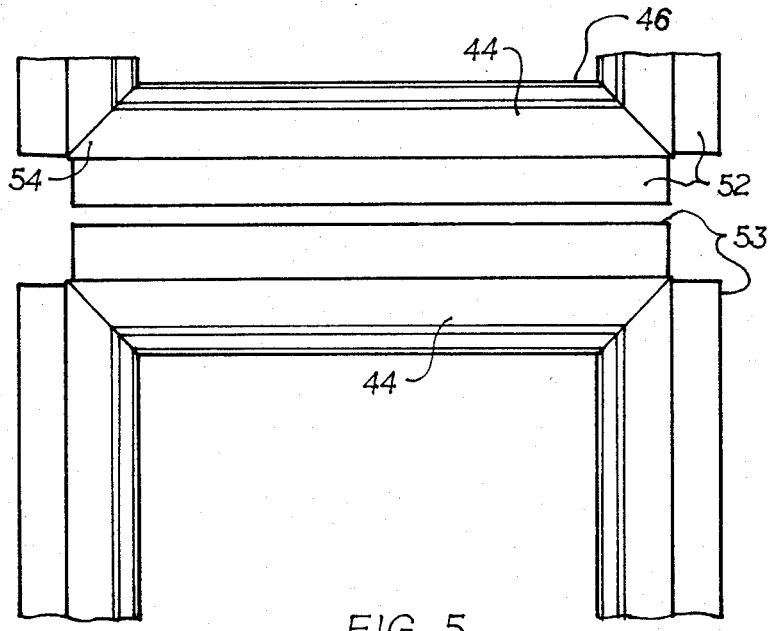
FIG. 5 is a plan view of the spacer device shown in FIG. 4, which view shows details of the joint at the corner of the sealed unit.

To construct the corner of a frame made from rigid structural and flexible spacers, the spacer frame is assembled to form a rectangle with either temporary or permanent corner pieces. Each corner is then dip-soldered at 53 (see FIG. 5) in a well known manner to seal the corner and permanently fasten the end of one spacer to the adjoining spacer. The glass plates are then attached to the sealed frame. In the case of flexible spacers, each corner piece must be removed after soldering to allow even flexibility at the corners.

After assembly of the flexible spacer frame and the glass plates as explained, it is necessary to adjust the distance between the glass plates by blowing air (or a gas such as argon) through a small breather tube into the space between the plates. Afterwards the hole in the tube is sealed shut.

It will be appreciated by those skilled in the construction of sealed glass units that the expandable spacers described herein provide a number of advantages to the user thereof. Such spacers permit the unit to adjust in order to equalize the sealed interior pressure and the outside atmospheric pressure. Such spacers also result in the tensile seal loads being reduced to approximately the magnitude of the spring stiffness. Further the lights of the unit will remain flat under normal conditions. Because the lights remain flat, the glass lights will not produce a distorted reflective image which to some persons may be objectionable. In addition if the interior light of the unit is the "fixed" light, the majority of the load will be carried on the interior light. The seal on the exterior light will then be subjected only to compressive loads. Consequently forces causing structural or moisture failure of the seals are basically eliminated, thereby increasing the longevity and safety of the unit. A further advantage of flexible spacers is that they minimize movements of the vapour seal because of the reduced stresses and strains in the sealed unit. Because of this, the lift of the unit is prolonged. Flexible spacers will also allow wider spacers than the usual ½ inch spacers to be used because extra expansion is no longer a problem. The use of a light gas which creates less convection than air will achieve greater thermal resistance in these thicker sealed units.

Various modifications and changes to the described embodiments will be apparent to those skilled in this art after considering the present disclosure and drawings. All such modifications and changes as fall within the scope of the appended claims are intended to form part of the present invention.

What I claim as my invention is:

1. A glass insulating sealed unit capable of being mounted on a building without the use of exterior stops comprising at least two spaced-apart glass plates and spacer means to join and seal the edge portions of said glass plates arranged about the entire periphery of said plates and between said plates, said spacer means including at least one connecting spacer device extending along at least one side of said unit, projecting therefrom, and adapted for the connection of said unit to an adjoining support member in order to support and fix said unit so that the exterior glass suface thereof is the outermost point of the unit and adjacent surrounding surfaces of said building.

2. A glass insulating sealed unit according to claim 1 wherein said at least one connecting spacer device comprises a first section forming a substantially enclosed, elongate cavity for holding dessicant, said first section being positioned between two glass plates adjacent edges thereof, and a second section in the form of an extension of said first section projecting outwardly to a position beyond the adjacent edges of the glass plates.

3. A glass insulating sealed unit according to claim 2 wherein said spacer device comprises a third section in the form of an integral extension of said first section projecting outwardly to a location directly between the adjacent edges of the glass plates and wherein said second section is bonded to one of said two glass plates by a structural sealant and said third section is bonded to the other of said two glass plates by a structural sealant.

4. A glass insulating sealed unit according to claim 2 wherein said second section has a first leg extending from said first section parallel to said glass plates to a position out from the edges of the glass plates and a second leg extending perpendicularly from said first leg and past the adjacent edge of one of said glass plates to a location beyond the plane of the outer surface of said one glass plate.

5. A glass insulating sealed unit according to claim 4 wherein said second leg is bonded to the adjacent edge of said one glass plate by a structural sealant.

6. A glass insulating sealed unit according to claim 5 wherein said at least one spacer device includes a third section in the form of another integral extension of said first section having a primary leg parallel to said glass plates and extending to a position out from the edges of the glass plates and a secondary leg extending perpendicularly from said primary leg and along the adjacent edge of the other of said glass plates.

7. A glass insulating sealed unit according to claim 6 wherein said secondary leg is bonded to the adjacent edge of said other glass plate by structural sealant.

8. A glass insulating sealed unit according to claim 4 wherein a flange extends from one side of second leg, said flange being parallel to said outer surface of said one glass plate and integrally formed with said spacer device, and wherein said flange lies adjacent said outer surface of said one glass plate.

9. A glass insulating sealed unit according to claim 8 wherein said spacer device includes a third section in the form of another integral extension of said first section projecting outwardly to a location directly between the adjacent edges of the glass plates, said third section being bonded to the other of said glass plates by a structural sealant.

10. A glass insulating sealed unit according to claim 1 wherein said at least one spacer device comprises two separate members securely fastened together, the first member forming a substantially enclosed, elongate cavity for holding dessicant and means on the outermost wall of said first member for holding the second member, and said second member extending outwardly from said first member to a position beyond the adjacent edges of the glass plates.

11. A glass insulating sealed unit according to claim 10 wherein said holding means defines an elongate slot which is wider at the bottom than at the mouth thereof and said second member has an anchor portion adapted to fit in the bottom of said slot and too wide to be pulled through the mouth of the slot.

12. A glass insulating sealed unit according to claim 11 wherein exterior surfaces of said holding means are bonded by structural sealant to the two glass plates on opposite sides of said first member.

13. A glass insulating sealed unit according to claim 1 wherein said at least one spacer device in cross-section comprises at least three parts integrally connected together, including a first part extending parallel to said glass plates and disposed entirely between adjacent edge portions of said glass plates, a second part extending perpendicularly from the inner end of said first part, and a third part connected to said second part and extending parallel to said first part to a position beyond the adjacent edges of the glass plates, structural sealant bonding at least said first part to the adjacent glass plate.

14. A glass insulating sealed unit according to claim 13 including a separate spacer member positioned adjacent to the at least one spacer device on the side of said second part furthest from the adjacent edges of said glass plates, said spacer member forming a substantially enclosed elongate chamber for holding dessicant.

15. A glass insulating sealed unit according to claim 13 wherein a compound capable of providing both a dessicant and a vapour seal is disposed between the glass plates and immediately adjacent to an inside surface of said at least one spacer device.

16. A glass insulating sealed unit according to claim 1 wherein there is a connecting spacer device along each side of said unit and at least two spacer devices are capable of expanding or contracting in the direction perpendicular to the plane of said glass plates in order to equalize the pressures inside of and outside of said sealed unit.

17. A glass insulating sealed unit according to claim 16 wherein each spacer device has a first section forming and expandable spring loop and located directly between two glass plates adjacent edges thereof and a second section projecting outwardly to a position beyond the adjacent edges of the glass plates and wherein said first section has one side bonded to one glass plate by a structural sealant and said second section is bonded to the other glass plate by a structural sealant.

18. A sealed unit according to claim 17 wherein said second action is rigidly connected to said first section and said second section is formed by extrusion.

19. An insulating sealed unit capable of being mounted on a building without the use of exterior stops comprising a glass plate, an insulating panel having dimensions lengthwise and widthwise similar to those of said glass plate, and means for sealingly connecting the periphery of said glass plate to said insulating panel while also sparating the plate from said panel a short distance, said connecting means being arranged about the entire periphery of said plate and panel and including at least one connecting spacer device extending along at least one side of said unit, projecting therefrom, and adapted for the connection of said unit to an adjoining support member in order to support and fix said unit so that the exterior glass surface of the glass plate is the outermost point of the unit and adjacent surrounding surfaces of said building.

20. An insulating sealed unit according to claim 19 wherein said at least one connecting spacer device comprises a first section forming a substantially enclosed, elongate cavity for holding dessicant, said first section being positioned between said plate and panel adjacent edges thereof, and a second section in the form of an integral extension of said first section projecting outwardly to a position beyond the adjacent edges of the glass plate and panel.

21. An insulating sealed unit according to claim 19 wherein said panel comprises two metal sheets substantially separated by a layer of rigid insulation.

22. A glass insulating sealed unit comprising at least two spaced-apart glass plates and spacer means to connect together and seal the edges of said glass plates arranged about the entire periphery of said plates, said spacer means including along at least two adjacent sides of said unit an expandible center section and two outer sections that are integral extensions of said center section for attaching the spacer means to inner surfaces of two adjacent glass plates, the outer sections being located on opposite sides of said center section, and nonmetallic structural sealant bonding each outer section to the adjacent inside surface of its respective glass plate, wherein at least one of said outer sections and said center section are positioned entirely between edge portions of the two glass plates and said center section comprises a rolled spring loop.

23. A sealed unit according to claim 22 wherein dessicant impregnated rope is provided within said spring loop.

24. A sealed unit according to claim 22 wherein said spring loop is integrally connected to the inside edge of each of said outer sections.

25. A sealed unit according to claim 24 wherein a gas other than air is provided and sealed in between said glass plates.

26. A sealed unit according to claim 23 wherein each of said outer sections is flat for a substantial portion of its width and bends outwardly towards the adjacent glass plate near the inner edge of the section, said structural sealant being located between the flat portion and the adjacent glass plate.

27. A sealed unit according to claim 26 wherein each of said outer sections in the region where it bends outwardly provides and forms a vapour seal seat.

28. A sealed unit according to claim 22 including connecting means for fastening said sealed unit to adjoining support members, said connecting means including flat apertured plates and threaded fasteners for mounting said plates.

29. A glass insulating sealed unit capable of being mounted on a building without the use of exterior stops comprising at least two spaced-apart glass plates and spacer means to join and seal the edge portions of said glass plates arranged about the entire periphery of said plates and between said plates, said spacer means including at least one connecting spacer device extending along at least one side of said unit and adapted for the connection of said unit to an adjoining support member in order to support and fix said unit so that the exterior glass surface thereof is the outermost point of the unit and adjacent surrounding surfaces of said building, said spacer device forming a channel-shaped recess that is open along the edge of the unit, and connectors for fastening said sealed unit by means of said spacer device to said adjoining support member, each of said connectors having a stem portion and flat arms projecting perpendicularly from one of end of said stem portion, wherein each connector is engaged with the spacer device and said adjoining support member when said sealed unit is in place by rotation of the connector about a center axis of said stem to turn one of said arms into said recess.

30. A sealed unit according to claim 29 wherein said at least one spacer device comprises a first section forming a substantially enclosed, elongate cavity for holding dessicant, said first section being positioned between two glass plates adjacent edges thereof, and a second section in the form of an integral extension of said first section projecting outwardly to and not beyond a location directly between the adjacent edges of the glass plates, and a third section in the form of an integral extension of said first section projecting outwardly to and not beyond a location directly between the adjacent edges of the glass plates.

31. A sealed unit according to claim 30 wherein each of said second and third sections is bonded to an inside surface of the glass plate closest thereto by a structural sealant.

32. A sealed unit according to claim 31 wherein the end of said stem portion furthest from said arms has locking members extending from opposite sides of said stem portion, said locking members being adapted for fastening said connector to said support member upon said rotation of said connector.

33. A glass insulating sealed unit capable of being mounted on a building without the use of exterior stops comprising at least two spaced-apart glass plates and spacer means to join and seal the edge portions of said glass plates arranged about the entire periphery of said plates and between said plates, said spacer means including at least one connecting spacer device extending along at least one side of said unit having a channel-shaped recess that is open along the edge of the unit, and separate connecting means for fastening said sealed unit by means of said spacer device to an adjoining support member, said connecting means having a flat end portion, wherein said sealed unit is fastened to said support member by insertion of said flat end portion into said recess and by attachment of said connecting means to said adjoining support member and said sealed unit is adapted to be held in place and supported on said adjoining support member by being clamped to said support member by said connecting means and wherein after the clamping operation the exterior glass surface is the outermost point of the unit and adjacent surrounding surfaces of said building.

34. A sealed unit according to claim 33 wherein said at least one spacer device comprises a first section forming a substantially enclosed, elongate cavity for holding dessicant, said first section being positioned between two glass plates adjacent edges thereof, and a second section in the form of an integral extension of said first section projecting outwardly and not beyond a location directly between the adjacent edges of the glass plates, and a third section in the form of an integral extension of said first section projecting outwardly to and not beyond a location directly between the adjacent edges of the glass plates.

35. A sealed unit according to claim 34 wherein said connecting means comprises a number of flat, elongate metal plates and said flat end portion is part of each metal plate which has a hole therein for passage of a threaded fastener.

36. A sealed unit according to claim 34 wherein said connecting means comprises a continuous L-shaped metal plate along two edges of said unit and said flat end portion is part of one leg of each plate, a hole for the passage of a threaded fastener being formed in the other leg.

* * * * *